US006110050A

United States Patent [19]

Tammera

[11] Patent Number: 6,110,050

[45] Date of Patent: Aug. 29, 2000

[54] TOY TRAIN HOPPER CAR

[76] Inventor: Robert F. Tammera, 56 Gilbert Pl., W. Orange, N.J. 07052

[21] Appl. No.: 09/327,271

[22] Filed: Jun. 7, 1999

[51] Int. Cl.[7] ..... A63H 19/15; A63H 33/30

[52] U.S. Cl. ..... 472/71; 40/415; 446/427; 446/428; 446/311

[58] Field of Search ..... 446/427, 428, 446/308, 311, 78; 105/1.5, 270; 213/75 TC; 298/1 R, 18, 23; 40/601, 415; 472/83, 71

[56] References Cited

U.S. PATENT DOCUMENTS

| | | | |
|---|---|---|---|
| 2,648,157 | 8/1953 | Wilson et al. . | |
| 2,705,388 | 4/1955 | Gokey . | |
| 3,119,201 | 1/1964 | Brown et al. . | |
| 4,159,594 | 7/1979 | Reiner et al. . | |
| 4,429,888 | 2/1984 | Wu | 446/427 |
| 4,495,719 | 1/1985 | Futatsuishi et al. | 40/601 |
| 5,435,768 | 7/1995 | Dunleavy | 446/427 |
| 5,879,221 | 3/1999 | Barton et al. | 446/427 |
| 5,989,096 | 11/1999 | Barton et al. | 446/425 |

*Primary Examiner*—Kien T. Nguyen
*Assistant Examiner*—Kevin Hughes
*Attorney, Agent, or Firm*—Edward Goldberg

[57] ABSTRACT

A toy train hopper car has a simulated load which appears to be emptied from a full load position. An electric motor drives a rotatable crank arm which engages a pivot arm connected to a load support that holds the simulated load. A second parallel pivot arm provides added support and follows the first pivot arm. A push button control actuates the motor to move the simulated load from an upper raised full load position to a lower empty load position and to reverse the movement.

8 Claims, 3 Drawing Sheets

TOY TRAIN HOPPER CAR

BACKGROUND OF THE INVENTION

1. Field of the Invention

The present invention relates to toy trains and particularly to a toy hopper cat which is filled with a simulated load. Activation of a crank arm drive and linkage mechanism causes the load to move down into the bottom of the hopper car until the lead disappears and the car appears to be empty.

2. Description of the Prior Art

U.S. Pat. No. 995,153 to Kingsbury shows a toy dump car having sloping ends directing a load of material to a central opening in the bottom plate. Dumping leaves swing open to permit a load to be dumped.

U.S. Pat. No. 2,186,737 to Smith shows a toy dump car having a tilting mechanism which raises one side of the car so that a load can be dumped out of the opposite side which is pivoted at the top to swing open.

Several other patents, U.S. Pat. No. 2,281,393 to Smith, U.S. Pat. No. 2,585,731 to Bonanno, and U.S. Pat. No. 2,949,695 to Zion, show various toy dump cars which also employ tilting mechanisms to pivot a side wall and tilt a bottom wall.

These mechanisms are generally complex and are used with actual miniature toy loads which are dumped from the cars into receiving bins for removal or recycling. These loads can leave an undesired residue which must be cleaned away.

SUMMARY OF THE INVENTION

It is therefore the primary object of the present invention to provide a toy hopper car with a simulated load that appears to have been dumped.

It is another object of the invention to provide a simple mechanism for a toy hopper car that simulates unloading of material from the hopper car.

A further object of the invention is to provide a mechanism for a toy hopper car that lowers and raises a simulated load to give the appearance of unloading and loading the hopper car.

An additional object of the invention is to provide a simple crank arm drive and linkage mechanism to lower and raise a simulated load which appears to empty and fill a hopper car.

It is also an object of the invention to employ a flexible material having an irregular coarse surface which simulates various loads that can be lowered within a hopper car which appears to have been emptied while avoiding undesired residues that require special handling and cleaning.

These objects are achieved with a unique structure and mechanism which utilizes a sheet of flexible material such as rubber which has the outer surface molded and colored to appear as a load of material such as coal or other aggregate.

A crank arm and linkage mechanism driven by a miniature electric motor support a planar board under the load which is held in an upper position in the hopper car to appear as a full load. When a control button is pushed to activate the motor via a power control track, the crank arm and linkage lower the support board and load to the lower part of the hopper car where the load disappears and the car appears to be empty. In order to refill the hopper, the button is pushed again and the crank arm and linkage raise the support board and simulated load to move to the upper area of the car until the hopper again appears to be full.

Other objects and advantages will become apparent from the following description in conjunction with the accompanying drawings.

DESCRIPTION OF THE PREFERRED EMBODIMENT

Figure 1:
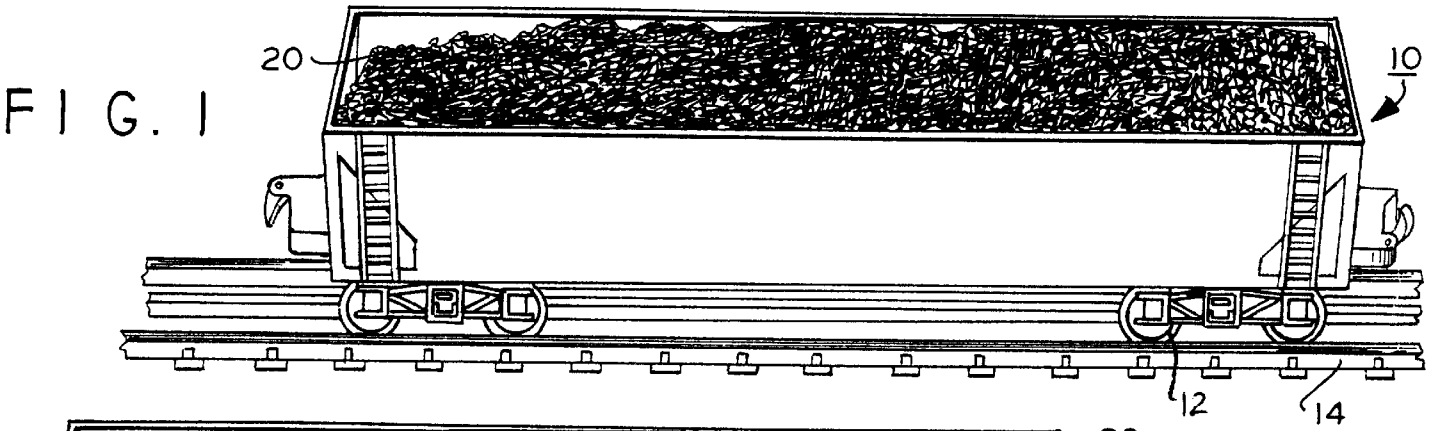
FIG. 1 is a side perspective view of a toy hopper car on track with a full simulated load.

As shown in FIG. 1, a typical toy train hopper car body 10 is mounted on a plurality of wheels or trucks 12 which engage a set of rails 14.

Figure 2:
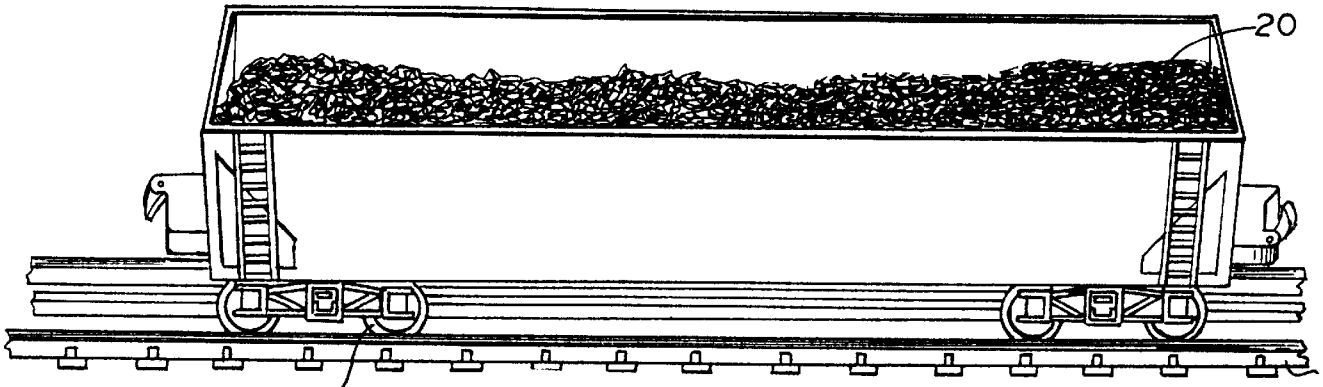
FIG. 2 is a side perspective view of the toy hopper car with a load that appears partially emptied.
Figure 3:
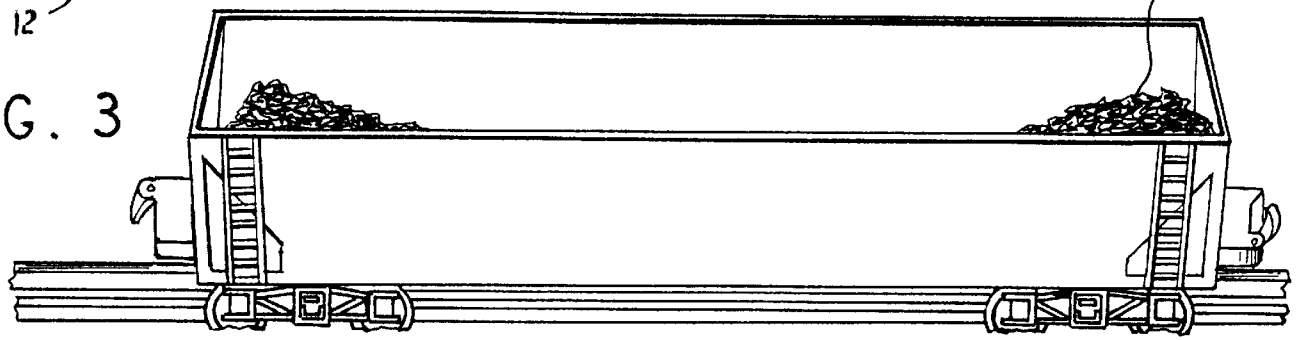
FIG. 3 is a side perspective view of the hopper car with a load that appears to be empty.
Figure 4:
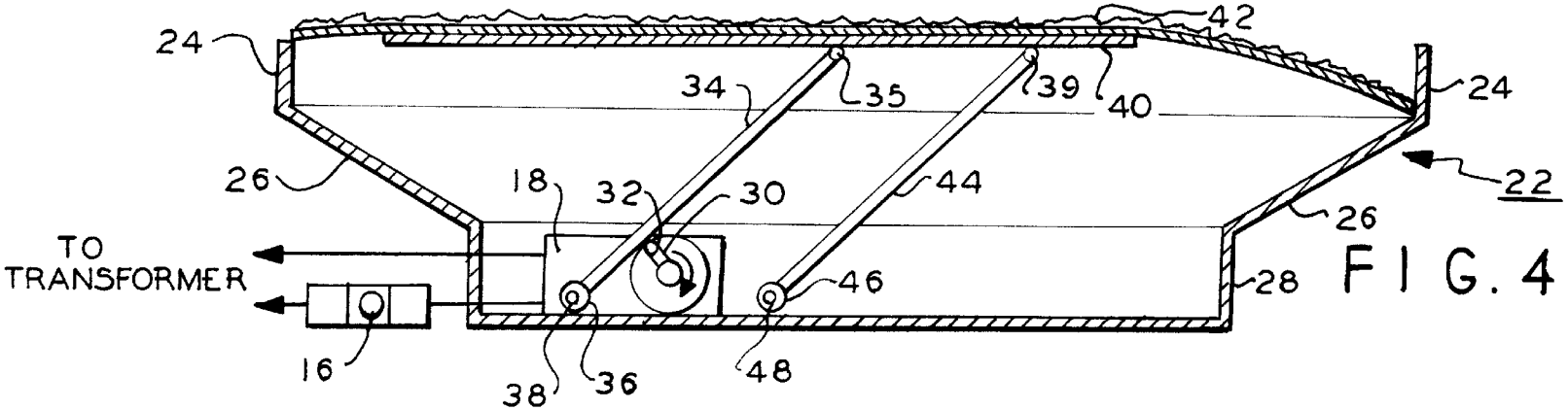
FIG. 4 is a side schematic sectional view of the interior of the hopper car showing the motor driven crank arm and linkage mechanism supporting the simulated load in a full upper position.

A standard third rail, not shown, engages rollers, not shown, under the car, which connect a remote power source through a transformer and push button control 16 to an electric motor-gear reduction drive 18 within the bottom of the car, as shown in FIG. 4. A simulated load 20, which for example is shown as coal in FIG. 1, is seen at the top of the car to appear as a full load of material. FIG. 2 shows the load 20 as having moved down in the car to appear to be unloading, while FIG. 3 shows the load to have substantially disappeared as if the car is empty and completely unloaded. The simulated load may be made to appear as a variety of other aggregates that can be carried in a hopper car such as sand, or other granular items, agricultural crops, building materials, and the like.

Figure 5:
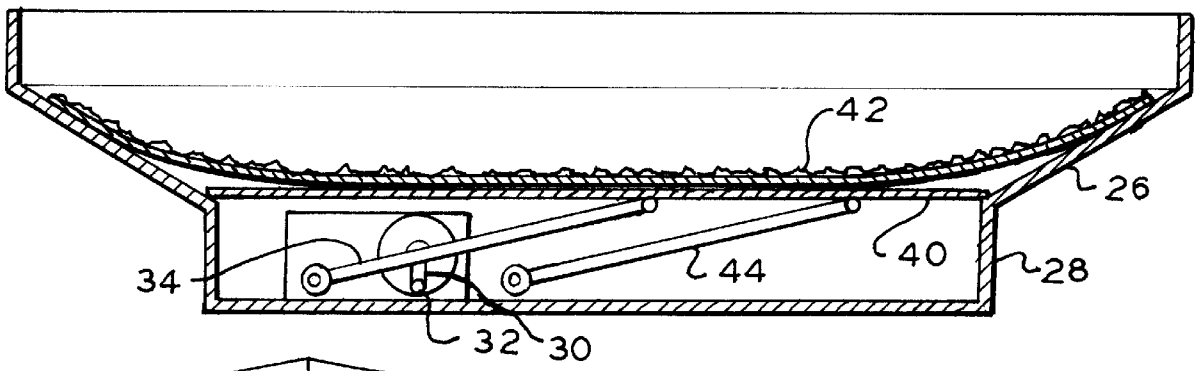
FIG. 5 is a side schematic sectional view of the interior of the hopper car showing the load in a lower empty position.
Figure 6:
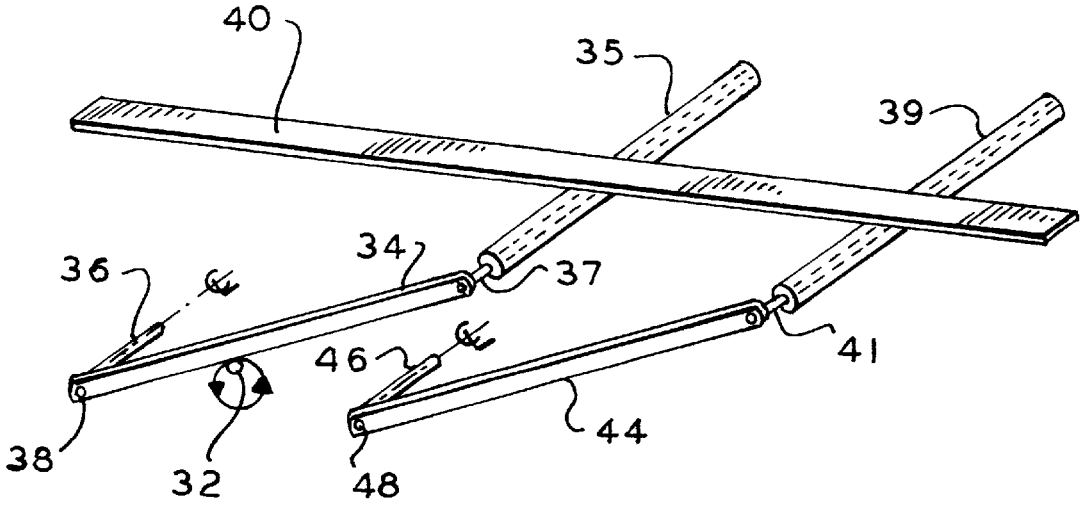
FIG. 6 is an isometric side view of the linkage mechanism for raising, lowering and supporting a simulated load.

The operation and structure of the device is shown more clearly in FIGS. 4, 5 and 6. The interior of the car includes a container 22 having upright end portions 24 at the top open area which lead into inwardly angled midsections 26 at opposite ends and upright lower ends 28 at the bottom of the container. Secured to the bottom of the container is an electric motor gear reduction drive assembly 18 which is activated by push button 16. The motor drives a 360 degree rotating crank arm 30, mounted on a plate and connected to a central shaft. The crank arm includes a side projecting extension 32 which in an initial full load position engages and supports a primary drive pivot arm or linkage 34. The lower end of arm 34 includes a tubular support 36 rotatably secured by a pin axle 38 to the side wall of the car, not shown, and an inner support, not shown.

The upper end of arm 34 is rotatably linked to a first laterally extending cross number 35 by pin axle 37. Member 35 is suitably fastened in a central area to a horizontal longitudinally disposed planar lift board 40 which may be formed of a thin layer of brass or other sturdy material. Board 40 may typically be about 1/16 inch in thickness and sufficiently rigid to support an upper load layer 42 which may be of rubber or other flexible material molded to simulate the appearance of a load such as coal. layer 42 may be about 1/16 to 1/8 inch in thickness and extend in length and width across the complete upper area of the car between opposite ends and sides. A secondary follower pivot arm 44 is spaced along the car bottom and mounted parallel to arm 34.

Arm 44 is similarly rotatably linked to a second cross member 39 by pin axle 41 with member 39 connected at a central area to lift board 40. The lower end of pivot arm 44 connects to tubular support 46 which is rotatably secured by a pin axle 48 to the side wall. Cross members 35, 39 and longitudinal board 40 support the load 42 across the full open area of the car. As shown in FIG. 4, the pivot arms 34, 44, crank arm 30, lift board 40, cross members 35,39 and simulated load 42 are in the maximum raised position to represent a fully loaded hopper car.

Figure 7:
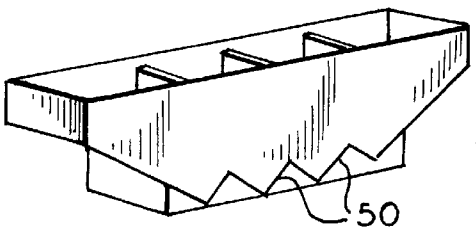
FIG. 7 is an angled side perspective view of a model toy hopper car showing the dumping leaves at the bottom to more realistically simulate the appearance of a standard sized car.

As shown in FIG. 5, with the control button 16 activated, the motor drive 18 rotates crank arm 30 clockwise to gradually move extension 32 around and downwardly to the bottom of the car. Pivot arm 34 also rotates downwardly until it is no longer supported by crank arm extension 32 and moves toward the car bottom. Board 40 and members 35,39 connected to the upper end of pivot arm 34 and to parallel pivot arm 44 also move downwardly toward the bottom, but the upper ends of upright lower end walls 28 prevent further lowering of board 40 which then rests on the opposite end walls 28. At the same time, load layer 42 supported by board 40 also moves downwardly toward the car bottom and thus largely disappears from view in the hopper car to simulate a load which has been emptied or dumped from the car. FIG. 7 shows dumping leaves or bays 50 at the car bottom to simulate the appearance of a hopper car.

Upon release of the control button 16, movement stops in the empty position. In order to again raise the load to simulate the full position, the button is reactivated to cause the crank arm to re-engage the pivot arm 34 which with pivot arm 44 and members 35,39 cause board 40 and load 42 to move upwardly to return to the upper hopper car area. The cycle may then be repeated whenever the user wishes to do so.

While only a single embodiment has been illustrated and described, other variations may be made in the particular configuration without departing from the scope of the invention as set forth in the appended claims.

What is claimed is:

1. A toy hopper car for simulating the unloading of material from the car comprising:

a car body having side walls, end walls, a bottom wall, a top, and an open area at the tope extending between said side and end walls;

drive means secured on said bottom wall within said body, said drive means including a rotatable crank arm;

a first pivot arm having a lower end rotatably secured at said bottom wall and engageable with said crank arm;

load support means completely within said body secured to the upper end of said first pivot arm;

a second pivot arm spaced along the length of said car body from said first pivot arm and disposed in parallel therewith, said second pivot arm having a lower end rotatably secured at said bottom wall and an upper end secured to said load support means;

a simulated load carried within said car body extending between said side and end walls and resting on said load support means, said simulated load having an appearance resembling that of load materials, said crank arm holding said pivot arms, load support means and simulated load in a first upper full load position at the top open area, said simulated load being visible at said top open area;

and means for actuating said drive means to rotate said crank arm to move said first and second pivot arms, load support means and simulated load downwardly toward a lower empty load position of limited visibility within said car body.

2. A toy hopper car for simulating the unloading of material from the car comprising:

a car body having side walls, end walls, a bottom wall, a top, and an open area at the top extending between said side and end walls;

drive means secured on said bottom wall;

a simulated load extending between said side and end walls disposed entirely within said car body above said drive means, said simulated load having an appearance resembling that of load materials;

pivotable lifting and lowering means completely within said body engageable with said drive means and supporting said simulated load within said body; and means for actuating said drive means to lift said simulated load to an upper visible full load position at said top open area and to lower said simulated load to a lower empty load position of limited visibility within said car body away from said top open area.

3. The toy hopper car of claim 2 wherein said drive means includes an electric motor gear reduction drive assembly and a rotatable crank arm, said pivotable lifting and lowering means including a first pivot arm having a lower end rotatably secured along said bottom wall and engageable with said crank arm, a second pivot arm spaced along said bottom wall from said first pivot arm and disposed in parallel therewith, said second pivot arm having a lower end rotatably secured along said bottom wall, and load support means secured to the upper ends of said first and second pivot arms;

said simulated load resting on said load support means and having the appearance of a load material carried within said car body, said crank arm being rotatable to hold said pivot arms, load support means and simulated load in said upper full load position and to release said pivot arms, load support means and simulated load to move to said lower empty load position;

said actuating means includes a source of electric power and a push button switch.

4. The toy hopper car of claim 3 wherein said load support means includes a longitudinally extending relatively rigid thin layer of material connected to said upper ends of said pivot arms, and said simulated load is a relatively flexible thin layer of material having a molded surface with the appearance of a load material extending within and across said car body.

5. The toy hopper car of claim 4 wherein said car body bottom wall is of a reduced dimension with said end walls tapering outwardly therefrom, said end walls limiting downward movement of said pivot arms, load support means and simulated load means to an empty load position spaced above said bottom wall.

6. The toy hopper car of claim 5 wherein the lower ends of said pivot arms include tubular supports engaging said bottom wall and central pins rotatably secured to a side wall.

7. The toy hopper car of claim 6 wherein said load support means includes a first laterally extending cross member rotatably secured to the upper end of said first pivot arm, and a second laterally extending cross member rotatably secured to the upper end of said second pivot arm, said longitudinally extending relatively rigid layer being a planar board secured to said cross members, said load resting on said board and said cross members.

8. The toy hopper car of claim 4 wherein said simulated load is a thin flexible layer of rubber having a molded surface with the appearance of a load of coal.

* * * * *